United States Patent [19]

Noda

[11] Patent Number: 4,727,367

[45] Date of Patent: Feb. 23, 1988

[54] DISPLAY APPARATUS HAVING A PLURALITY OF DISPLAY ELEMENTS

[75] Inventor: Tomimitsu Noda, Nagoya, Japan

[73] Assignee: Kabushiki Kaisha Toshiba, Kawasaki, Japan

[21] Appl. No.: 805,904

[22] Filed: Dec. 6, 1985

[30] Foreign Application Priority Data

Jan. 16, 1985 [JP] Japan ..... 60-5350

[51] Int. Cl.[4] ..... G09F 9/33; G09G 3/14

[52] U.S. Cl. ..... 340/811; 340/805; 340/752

[58] Field of Search ..... 340/805, 811, 812, 814, 340/752

[56] References Cited

U.S. PATENT DOCUMENTS

| | | | |
|---|---|---|---|
| 3,728,714 | 4/1973 | Kolesar et al. | 340/814 |
| 3,787,752 | 1/1974 | Delay | 340/811 |
| 4,441,106 | 4/1984 | Jackson | 340/811 |

*Primary Examiner*—Howard A. Birmiel

*Attorney, Agent, or Firm*—Cushman, Darby & Cushman

[57] ABSTRACT

A display apparatus including a display device which is formed with a plurality of display elements. A drive circuit supplies a drive voltage from a rectified AC commercial supply voltage to the individual display elements. A control circuit controls the drive circuit to sequentially energize the display elements over a phase angel of the AC supply which minimizes differences in the voltage applied across the individual display elements, thus avoiding flickering in the display of the display device even if fluctuations of the drive voltage applied to the display elements occur.

6 Claims, 7 Drawing Figures

DISPLAY APPARATUS HAVING A PLURALITY OF DISPLAY ELEMENTS

BACKGROUND OF THE INVENTION

1. Field of the Invention

The present invention relates to display apparatus, and in particular, to display apparatus including display elements for displaying a plurality of digits.

2. Description of the Prior Art

Generally, domestic electrical appliances such as microwave ovens include display devices which display, for example, the remaining time for cooking or the temperature of food during a cooking operation. These display devices are provided with a number of display elements, each of which is formed in a segment arrangement with light-emitting diodes. The driving of the display elements may be multiplexed so that the number of signal wires between each display element and a drive voltage source can be reduced. Various types of the above-described prior art will be described in more detail with reference to FIGS. 1 to 3.

FIG. 1 shows a static drive type display apparatus. A display device 1 includes display elements $D_1$, $D_2$, $D_3$ and $D_4$, each of which is formed with light-emitting diodes. Each one of the terminals (digit terminals) of individual display elements $D_1$, $D_2$, $D_3$ and $D_4$ is connected to the secondary side of a transformer 3 through parallel connected diodes 5 and 7. Other terminals (segment terminals) thereof are connected to a microcomputer 9 individually. An input of microcomputer 9 is connected to center tap 11 of transformer 3, whose primary side is connected to commercial voltage supply 13. Display elements $D_1$, $D_2$, $D_3$ and $D_4$ are sequentially switched on and off by microcomputer 9. In other words, display elements $D_1$, $D_2$, $D_3$ and $D_4$ are supplied, in turn, with a prescribed D.C. voltage which is produced by transforming and full-wave rectifying the commercial voltage of voltage supply 13.

FIG. 2 shows a duplex drive type display apparatus, in which one of the terminals (digit terminals) of individual display elements $D_1$ and $D_3$ are connected in parallel to one another and connection point 15*a* thereof is connected to one of the secondary side terminals of transformer 3 through diode 5. One of the terminals (digit terminals) of individual display elements $D_2$ and $D_4$ are also connected in parallel to one another and the connection point 15*b* thereof is connected to another secondary side terminal of transformer 3 through diode 7. Other terminals (segment terminals) of display element $D_1$ are connected in parallel to corresponding terminals of display element $D_2$, respectively, and the individual connection points are connected to microcomputer 9. In the same manner, corresponding other terminals (segment terminals) of display elements $D_3$ and $D_4$ are connected in parallel and each connection point is connected to microcomputer 9 individually. Thus, the positive half-wave voltage of power supply 13, obtained through diode 5, is supplied to display elements $D_1$ and $D_3$, and the negative half-wave voltage thereof, obtained through diode 7, is supplied to display elements $D_2$ and $D_4$. The operation of display elements $D_1$ and $D_3$ and the operation of display elements $D_2$ and $D_4$ are carried out in parallel by microcomputer 9.

In the above-described display apparatus, however, there is a drawback that ripple components in the voltage of the commercial voltage supply 13 cause flickering on display device 1, and spoils its display.

To solve the above drawback, in a dynamic drive (multiplex) type display apparatus as shown in FIG. 3, the operating voltage for display device 1 is obtained from a stabilized DC power supply 17. In FIG. 3, one set of terminals of individual display elements $D_1$, $D_2$, $D_3$ and $D_4$ is connected to microcomputer 9 through a digit driver 18, and other corresponding sets of terminals for the display elements are connected in parallel and the individual connection points are connected to microcomputer 9 through a segment driver 19. Stabilized DC power supply 17, obtained by rectifying and stabilizing the commercial voltage, is connected between digit driver 18 and segment driver 19. With this arrangement, since the ripple components in the commercial voltage can be eliminated, it is possible to achieve a stable display.

However, the stabilized DC power supply provided to prevent display flickering causes some new problems by complicating the circuit arrangements and increasing production costs. In addition, there is also a problem of large power losses in the stabilized DC power supply.

SUMMARY OF THE INVENTION

It is an object of the present invention to provide an improved display apparatus, which achieves a stable display without causing any visible flickering and any power losses, which maintains a low production cost.

To accomplish the above-described object, the present invention provides a display apparatus including display elements for displaying a plurality of digits, a drive circuit for supplying drive voltage from a rectified AC commercial supply voltage to the individual display elements by scanning the elements in turn and a drive control circuit which causes each scanning cycle of the drive circuit to occur in a phase angle of $\rho/2$ radians of a period of the AC commercial supply voltage or a phase angle of an integer multiple of $\rho/2$ radians thereof.

BRIEF DESCRIPTION OF THE DRAWINGS

These and other objects and advantages of this invention will become more apparent and more readily appreciated from the following detailed description of the presently preferred exemplary embodiment of the invention, taken in conjunction with the accompanying drawings of which.

DETAILED DESCRIPTION OF THE PREFERRED EXEMPLARY EMBODIMENT

A preferred embodiment of the present invention will now be described in more detail with reference to the accompanying drawings.

Figure 4:
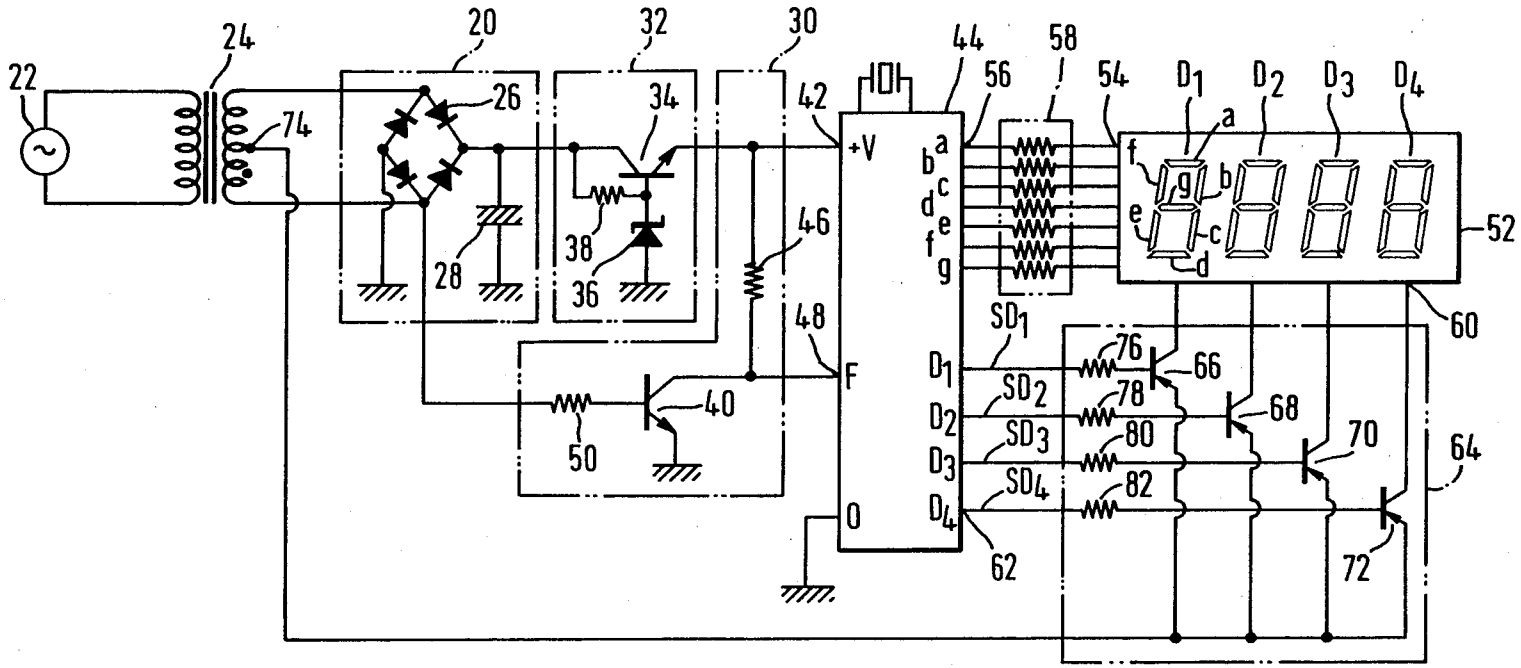
FIG. 4 is a circuit diagram of a display apparatus in accordance wtih one embodiment of the present invention.

An overall circuit of the display apparatus of this invention is shown in FIG. 4. A rectifying circuit 20 is connected to a commercial power supply 22 through a transformer 24. Rectifying circuit 20 includes four bridge diodes 26 and a smoothing capacitor 28. The output of rectifying circuit 20 is connected to a phase detector circuit 30 through a voltage-stabilizing circuit 32. Voltage-stabilizing circuit 32 includes NPN-type transistor 34 having a collector connected to the output of rectifying circuit 20, an emitter connected to phase-detector circuit 30 and a base connected both to ground through a zener diode 36 and to its collector through a resistor 38. Phase detector circuit 30 includes NPN-type transistor 40. The collector of transistor 40, is connected to the emitter of transistor 34 and the power input terminal 42 of a microcomputer 44 (drive control circuit) through resistor 46. The other end of resistor 46 is connected to input terminal 48 of microcomputer 44. The base of transistor 40 is connected to the secondary side of transformer 24 through resistor 50, and its emitter is connected to ground. Thus, phase detector circuit 30 outputs a pulse signal corresponding to the phase of the voltage of commercial power supply 22.

Figure 5:
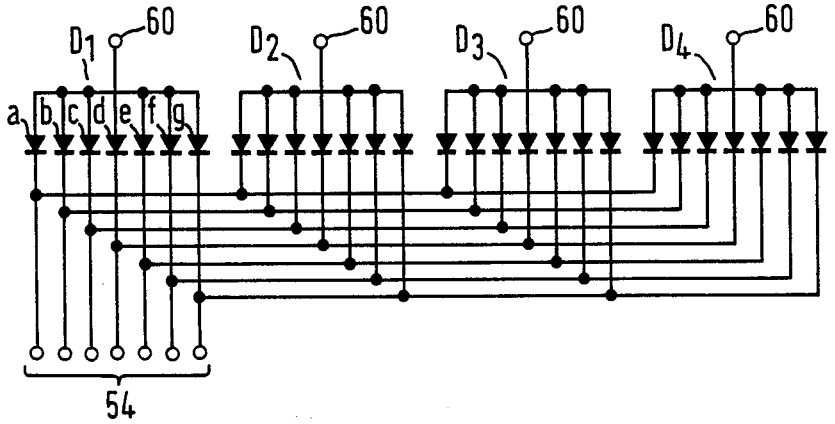
FIG. 5 is a schematic wiring diagram of display elements shown in FIG. 4.

A display device 52 includes a plurality of display elements, e.g., four ($D_1$, $D_2$, $D_3$ and $D_4$), each of which is formed with seven light-emitting diodes (a, b, c, d, e, f and g) arranged in segment formation as shown in FIG. 5. Thus, display with the four display elements denotes a four-digit numeral. Corresponding light-emitting diodes among display elements $D_1$, $D_2$, $D_3$ and $D_4$ are connected in parallel with each other. Each of segment terminals 54, connected to light-emitting diodes a, b, c, d, e, f and g of each display element, is also connected to corresponding segment signal outputs 56 of microcomputer 44 through a segment drive circuit 58. Digit signal terminals 60 of display device 52 are connected to individual digit signal outputs 62 of microcomputer 44 through a digit drive circuit 64. Digit drive circuit 64 includes four PNP-type transistors 66, 68, 70 and 72 corresponding to individual display elements $D_1$, $D_2$, $D_3$ and $D_4$. Each of digit signal terminals 60, connected to individual display elements $D_1$, $D_2$, and $D_3$ and $D_4$, is connected in common to center tap 74 of the secondary side of transformer 24 through the collectors and emitters of transistors 66, 68, 70 and 72. Each base of transistors 66, 68, 70 and 72 is connected to corresponding digit signal outputs 62 of microcomputer 44 through individual resistors 76, 78, 80 and 82. Microcomputer 44 causes digit drive circuit 64 to output pulse signals, synchronized with the phase of the voltage of commercial power supply 22, in turn from its outputs (collectors of individual transistors 66, 68, 70 and 72).

Figure 6:
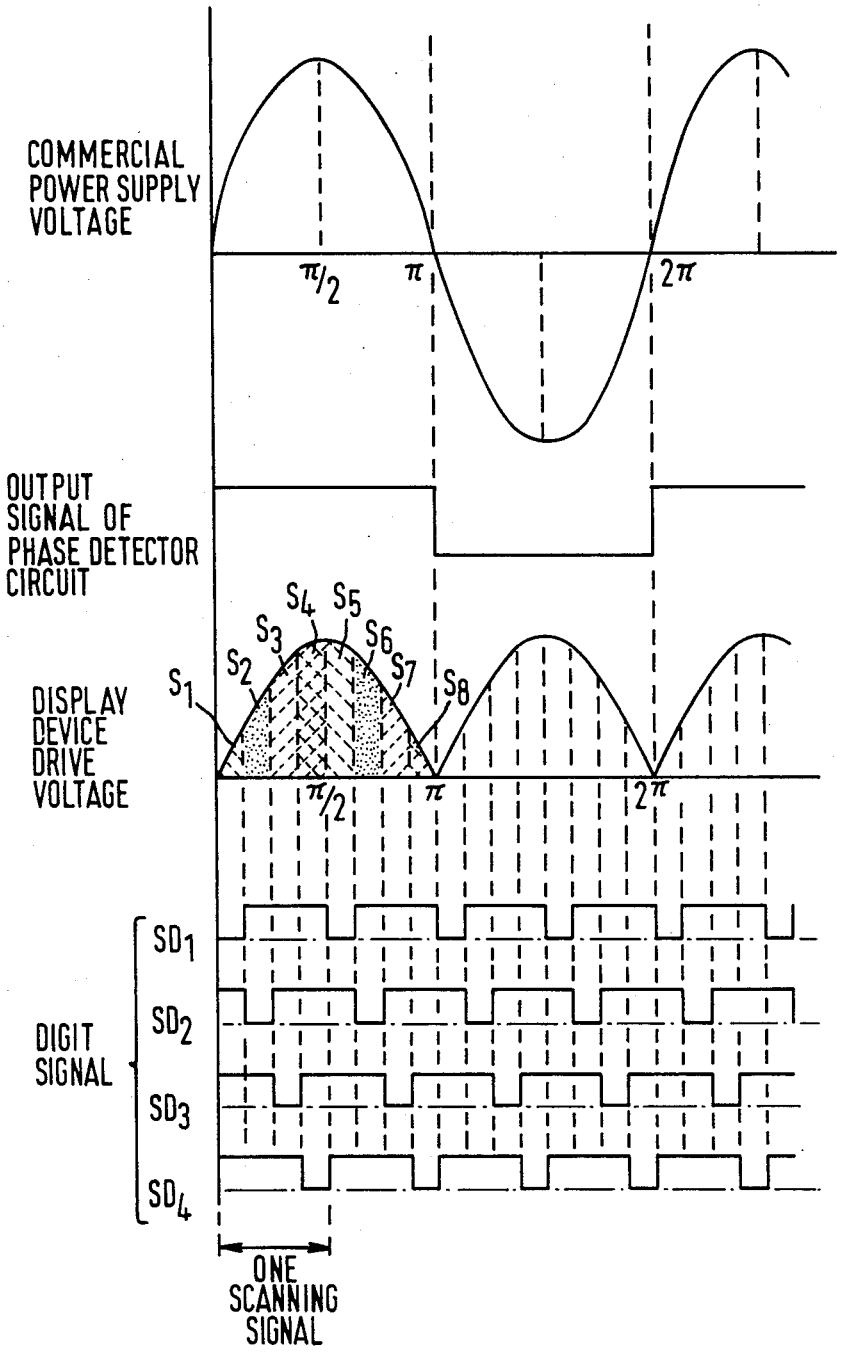
FIG. 6 is a timing diagram of the signals generated by the circuit shown in FIG. 4.

The operation of the above circuit arrangement will be described with reference to FIGS. 4 to 7. When commercial power supply 22 is turned on, input 48 of microcomputer 44 receives a pulse signal, synchronized with the phase of the voltage of commercial power supply 22, as shown in FIG. 6, from phase-detector circuit 30.

Microcomputer 44 detects the phase of the voltage of commercial power supply 22 on the basis of the pulse signal. Then, microcomputer 44 outputs segment signals, corresponding to a specific numeral information to be displayed, from its segment signal outputs 56, respectively. At the same time, microcomputer 44 begins to set its digit signal $SD_1$, $SD_2$, $SD_3$ and $SD_4$ sequentially to logical 0 in synchronism with a timing at which the phase of the voltage of the commercial power supply 22 crosses zero points, as shown in FIG. 6. When digit signal $SD_1$ goes to logical 0, transistor 66 of digit drive circuit 64 is turned on, and the display device drive voltage component $S_1$ produced by transformer 24 is applied to display element $D_1$. For example, if segment signals fed from segment signal outputs a, b and c of microcomputer 44 are applied to light-emitting diodes a, b and c, display element $D_1$ displays numeral 7. In the same manner, when digit signal $SD_2$ goes to 0, the display device driving voltage component $S_2$ is applied to display element $D_2$ through transistor 68. Thus, display elements $D_1$, $D_2$, $D_3$ and $D_4$ are driven in turn, and the specific numeral information display is carried out by display device 52. In this case, one scanning cycle for driving display elements $D_1$, $D_2$, $D_3$ and $D_4$ is carried out in a phase angle of $\pi/2$ radian of the commercial power supply voltage as shown in FIG. 6.

The following TABLE I shows the comparison of the individual display drive voltages (corresponding to the amounts of current flow) which are applied to display elements $D_1$, $D_2$, $D_3$ and $D_4$ while correpsonding digit signals $SD_1$, $SD_2$, $SD_3$ and $SD_4$ are logical 0. The applied voltage components to display elements $D_1$, $D_2$, $D_3$ and $D_4$ are given by the individual waveform areas of the display device drive voltage, respectively.

TABLE I

| DISPLAY ELEMENT | TOTAL AMOUNT OF THE APPLIED VOLTAGE COMPONENTS |
|---|---|
| $D_1$ | $S_1 + S_5 = 0.459$ |
| $D_2$ | $S_2 + S_6 = 0.541$ |
| $D_3$ | $S_3 + S_7 = 0.541$ |
| $D_4$ | $S_4 + S_8 = 0.459$ |

The individual waveform areas of the display device drive voltage are calculated by the expression below, normalizing the maximum value of the display device drive voltage to 1. (n is the number of digits, k is an integer (1, 2, . . . ), x can range between 0 and $2\pi$)

$$S_k = \int_{k\pi/2n}^{(k+1)\pi/2n} \sin x \cdot dx$$

Figure 1:
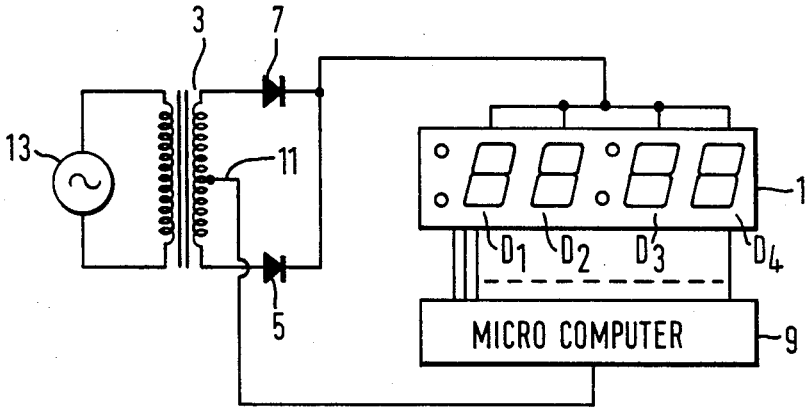
FIG. 1 (PRIOR ART)
FIGS. 1 to 3 are block diagrams of conventional type display devices.
Figure 2:
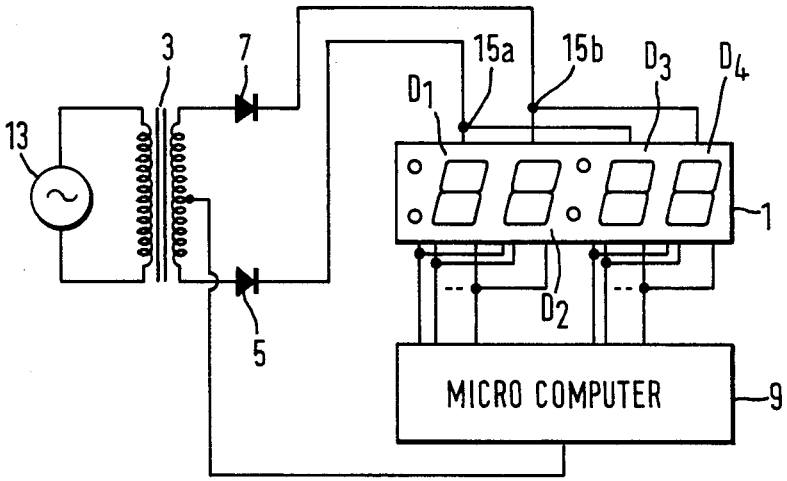
FIG. 2 (PRIOR ART)
Figure 3:
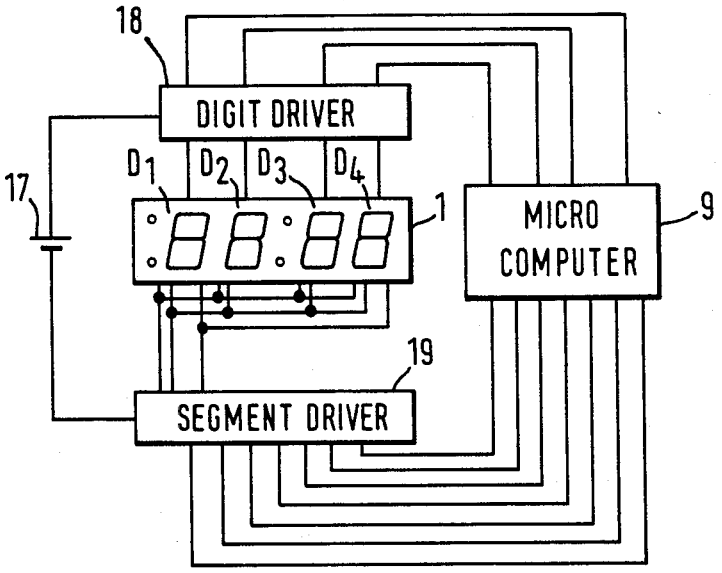
FIG. 3 (PRIOR ART)

As can be understood from TABLE I, the voltages applied to display elements $D_2$ and $D_3$ are maximum, and the voltages applied to display elements $D_1$ and $D_4$ are minimum, the ratio between the maximum and minimum values is $0.541/0.459 = 1.18$. Thus, it is possible to minimize the ratio therebetween. In other words, the difference between the voltage components applied to individual display elements $D_1$, $D_2$, $D_3$ and $D_4$ can be minimized. This prevents the display of display device 52 from flickering even if fluctuations of the applied voltages due to ripple components in the commercial power supply voltage would occur during a half-wave period thereof. With this embodiment, the circuit constitution thereof is simpler than that of the conventional type which is applied with a stabilized DC power supply as shown in FIG. 3. Therefore, reduced cost and power losses can be maintained.

Figure 7:
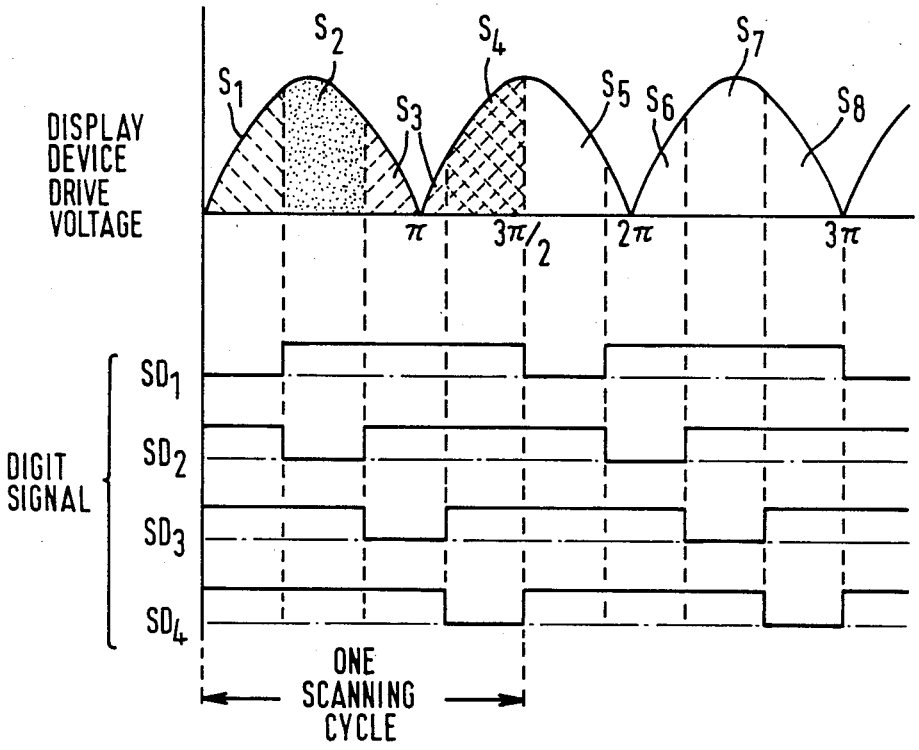
FIG. 7 is a timing diagram of a modification to one embodiment of the invention.

Although one display cycle for driving display elements $D_1$, $D_2$, $D_3$ and $D_4$ is carried out in $\pi/2$ radians in this embodiment, it can be also carried out in an integer multiple of $\pi/2$ radians, e.g., $3\pi/2$ radians as shown in FIG. 7. In this case also, the ratio between the maximum and minimum values of the voltage applied to display elements $D_1$, $D_2$, $D_3$ and $D_4$ can be minimized, that is, $1.542/1.459 = 1.06$.

Furthermore, the above-described embodiment employs four display elements. It is also possible to employ five elements. The following TABLE II shows the amount of individual voltages applied to the five display elements ($D_1$, $D_2$, $D_3$, $D_4$ and $D_5$) in the same manner as TABLE I.

TABLE II

| DISPLAY ELEMENT | TOTAL AMOUNT OF THE APPLIED VOLTAGE COMPONENTS |
|---|---|
| $D_1$ | $S_1 + S_6 = 0.358$ |
| $D_2$ | $S_2 + S_7 = 0.421$ |
| $D_3$ | $S_3 + S_8 = 0.378$ |
| $D_4$ | $S_4 + S_9 = 0.421$ |
| $D_5$ | $S_5 + S_{10} = 0.358$ |

As can be understood from TABLE II, the ratio between the maximum and minimum values is $0.421/0.358 = 1.176$.

The following TABLE III shows the amount of individual voltages applied to four display elements $D_1$, $D_2$, $D_3$ and $D_4$ when one scanning cycle extends for $\pi/2$ radians, but the beginning of the cycle is offset by $\pi/16$ radians from a point where the AC supply has zero amplitude, for understanding the present invention.

TABLE III

| DISPLAY ELEMENT | TOTAL AMOUNT OF THE APPLIED VOLTAGE COMPONENTS |
|---|---|
| $D_1$ | $S_1 + S_5 = 0.510$ |
| $D_2$ | $S_2 + S_6 = 0.553$ |
| $D_3$ | $S_3 + S_7 = 0.510$ |
| $D_4$ | $S_4 + S_8 = 0.394$ |

As can be seen in TABLE III, the ratio between the maximum and minimum values is $0.553/0.394 = 1.40$. If the ratio therebetween is large, i.e., 1.40 (in this case), when fluctuations of the voltage applied to the display elements occur during a half-wave period thereof, the flickering phenomenon will appear on the display of the display device due to the increased difference between the voltages applied to individual display elements.

In summary, it will be seen that the present invention overcomes the disadvantages of the prior art and provides an improved display apparatus which is capable of achieving a stable display even if fluctuations of the voltages applied to individual display elements occur during a display operation.

Many changes and modifications in the above-described embodiment can be carried out without departing from the scope of the present invention. Therefore, the appended claims should be construed to include all such modifications.

What is claimed is:

1. A display apparatus comprising:

means for displaying information, said displaying means including a plurality of display elements;

means for selectively supplying a drive voltage, rectified and proportional to commercial AC line voltage, across individual display elements of said display means; and drive control means for controlling said supplying means to sequentially apply voltage across said display elements, each of said display elements being energized once over a selected phase angle of $n\pi/2$ radians, where n is an integer, of the commercial AC line voltage, said selected phase angle minimizing differences in the drive voltage applied across said individual display elements during a display operation thereby minimizing visible flickering of the display.

2. The display apparatus according to claim 1, further including phase detector means for sending a phase signal, synchronized with the commercial AC line voltage, to said drive control means.

3. The display apparatus according to claim 2, wherein said drive control means initiates a voltage applying sequence in synchronism with a timing at which the amplitude of the commercial AC line voltage crosses zero voltage points on the basis of the phase signal from said phase detector means.

4. The display apparatus according to claim 1, wherein each of the display elements of said display means includes a plurality of segments of light-emitting diodes.

5. The display apparatus according to claim 4, wherein corresponding segments among said display elements are connected in parallel with one another.

6. The display apparatus according to claim 5, wherein said drive control means includes means for driving selected segments of said individual display elements on the basis of the information to be displayed.

* * * * *